US006826379B2

(12) United States Patent
Saito et al.

(10) Patent No.: US 6,826,379 B2
(45) Date of Patent: Nov. 30, 2004

(54) WASHING METHOD FOR CHARGING MEMBER

(75) Inventors: Shinichiro Saito, Minamiashigara (JP); Kazunari Koga, Minamiashigara (JP); Toshiaki Murofushi, Minamiashigara (JP); Akihiko Suzuki, Minamiashigara (JP); Akihito Suzuki, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/382,273

(22) Filed: Mar. 5, 2003

(65) Prior Publication Data

US 2003/0219281 A1 Nov. 27, 2003

(30) Foreign Application Priority Data

Mar. 5, 2002 (JP) ..... 2002-058963

(51) Int. Cl.[7] ..... G03G 15/00

(52) U.S. Cl. ..... 399/109; 399/99; 399/100

(58) Field of Search ..... 15/256.51, 256.52; 399/100, 109, 343, 345, 346, 347, 352, 357, 353

(56) References Cited

U.S. PATENT DOCUMENTS 6,254,976 B1 * 7/2001 Ono ..... 428/304.4

FOREIGN PATENT DOCUMENTS

| | | |
|---|---|---|
| JP | 6-289755 | 10/1994 |
| JP | 7-89627 | 4/1995 |
| JP | 11-125935 | 5/1999 |
| JP | 2001-51481 | 2/2001 |
| TW | 460294 | 10/2001 |

* cited by examiner

*Primary Examiner*—Hoang Ngo
(74) *Attorney, Agent, or Firm*—Fildes & Outland, P.C.

(57) ABSTRACT

The invention provides a washing method for a charging member by removing the deposited substance on the surface, thus making the charging member reusable. The washing method, for an electrophotographic charging member to be pressed to the surface of a member to be charged thereby charging the member to be charged, has a step of washing the surface of the charging member at least once with an acidic aqueous solution.

8 Claims, 1 Drawing Sheet

WASHING METHOD FOR CHARGING MEMBER

BACKGROUND OF THE INVENTION

1. Field of the Invention

The present invention relates to a washing method for a charging member by removing deposited materials adhered to the surface of a charging member, employed in an image forming apparatus of an electrophotographic system.

2. Related Art

In an image forming apparatus of an electrophotographic process in which an electrostatic latent image is formed on a photosensitive member and is developed with toner to obtain a toner image, there is widely employed a charging member which follows the rotation of the photosensitive member in contact with the surface thereof, thereby providing the photosensitive member with a charge. Toner and paper dusts tend to be deposited on the surface of such charging member, because it is given a charge at the image formation. Since such deposited substance sticks to the surface of the charging member, the charging ability thereof is lowered, thereby leading likely to an unsatisfactory image quality.

Since such deposited substance is firmly adhered to the surface of the charging member, it cannot be easily removed by a wiping with a dry cloth.

As one of the regeneration methods for the charging member, a method of peeling off a surface layer together with the adhered deposited substance and reforming the surface layer is practiced, but is associated with a drawback of a high process cost. On the other hand, JP-A-6-289755 and JP-A-7-89627 disclose washing methods of employing an organic solvent as a washing liquid and rub-washing the charging member with a brush in the organic solvent or executing ultrasonic washing in the organic solvent.

However, the washing of the charging member with an organic solvent may result in dissolution of the surface film or may cause a serious damage to the surface characteristics of the charging member even if the surface film is not dissolved. Therefore, JP-A-2001-51481 proposes a method of washing the charging member with water. However, because of the weak washing power, this method may be unable to completely remove the deposited substance and smear may remain over the entire surface of the charging member or a part thereof. In such case, the charging member cannot be reused.

SUMMARY OF THE INVENTION

The present invention has been made in view of the above circumstances and provides a washing method for a charging member, by removing the deposited substance on the surface thereof, thereby enabling re-use of the charging member.

More specifically, the invention provides a washing method for an electrophotographic charging member to be pressed to a surface of a member to be charged thereby charging the member to be charged, the method comprising a step of washing the surface of the charging member at least once with an acidic aqueous solution.

BRIEF DESCRIPTION OF THE DRAWINGS

Preferred embodiments of the present invention will be described in detail based on the following figures, wherein.

DETAILED DESCRIPTION OF THE EMBODIMENTS

Figure 1:
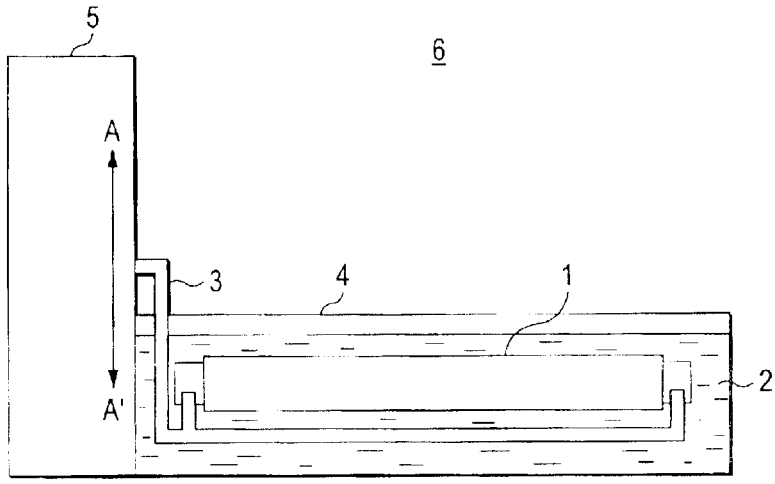
FIG. 1 is a schematic view showing an example of an immersion washing apparatus adapted for use in the washing method for the charging member of the present invention.

In the following, the present invention will be explained in the sections of and in the order of a washing method for a charging member, a washing apparatus and a charging member.

<Washing Method of Charging Member>

The present invention provides a washing method for an electrophotographic charging member to be pressed to a surface of a member to be charged thereby charging the member to be charged, the method comprising a step of washing the surface of the charging member at least once with an acidic aqueous solution.

This washing method for the charging member of the present invention allows to obtain a reusable charging member.

The surface of aforementioned charging member is preferably coated with a polyamide resin. In case the surface of the charging member is covered with the polyamide resin, certain organic solvents may not be usable for washing because the surface of the charging member may be eroded by such organic solvent if used for washing. Also washing with other solutions than aforementioned acidic aqueous solution, for example with a neutral aqueous solution, may be unable to sufficiently remove the smear on the surface of the charging member. However, in case the surface of the charging member is coated with a polyamide resin, the washing at least once with the acidic aqueous solution can securely remove the smear on the surface of the charging member.

The polyamide resin is not particularly limited as long as the surface contains a known polyamide resin, but it is preferred that the content of polyamide resin is equal to or higher than 50 mass % and more preferred that the surface of the charging member is coated solely with the polyamide resin. Examples of the polyamide resin include nylon 6, nylon 66, nylon 12 and methoxymethylated nylon.

Also, the thickness of the polyamide resin covering the surface of the charging member is preferably equal to or larger than 2 $\mu$m. A thickness smaller than 2 $\mu$m may result, in case of rub-washing, in peeling of the polyamide resin layer which covers the surface of the charging member.

In the present invention, the acidic aqueous solution means an aqueous solution having a pH value not exceeding 6, preferably not exceeding 5.5 and more preferably not exceeding 5. In case the pH value exceeds 6, a sufficient washing effect may not be obtained and the charging member after washing may not be re-usable.

The lower limit of the pH value of the acidic aqueous solution is not particularly limited, but preferably 1.5 or higher, more preferably 2 or higher. A pH value smaller than 1.5 may result in a drawback such as corrosion of the washing apparatus or the washing tank by the acidic aqueous solution. In the invention, the pH value means a value at 25° C.

The components of the acidic aqueous solution include at least water constituting a solvent and an acid component, but there may added if necessary other water-soluble additives such as a surfactant.

The solvent can also be, in addition to water, a water-soluble solvent used in combination with water. The water-soluble solvent can be any of known ones, for example alcohols such as isopropyl alcohol.

As the acid component, there can be employed any known acid component. Examples of the acid component include, in case of an inorganic acid, hydrochloric acid, sulfuric acid, nitric acid and phosphoric acid, and, in case of an organic acid, carboxylic acids such as acetic acid, formic acid, glycollic acid, malic acid or succinic acid, and sulfonic acid such as benzenesulfonic acid.

These acid components may be used singly or in a combination of two or more kinds. The acid component and other additive components to be used, and the concentrations thereof are selected in such a manner that the charging member after washing becomes re-usable, namely that the erosion of the surface of the charging member is practically negligibly small and a sufficient washing effect can be obtained.

In order to obtained the above-described effects, the acidic aqueous solution preferably includes at least a carboxylic acid or the like. The carboxylic acid preferably includes a hydroxyl group in the molecule in addition to the carboxyl group, and the carboxylic acid molecule more preferably includes one or two hydroxyl groups and one or two carboxyl groups. Examples of such carboxylic acid include glycollic acid, malic acid and succinic acid, and such carboxylic acids may be used singly or in a combination of two or more kinds. In case of using a carboxylic acid, the concentration thereof in the acidic aqueous solution is preferably adjusted within a range of 0.02 to 5 mass %.

The washing method of the invention for the charging member is not particularly restricted as long as it includes a step of washing at least once with the acidic aqueous solution, but also includes a washing process in plural steps which include washing with a washing liquid other than the acidic aqueous solution, namely with an aqueous solvent or solution having a pH value larger than 6 or with an organic solvent or solution. Such washing liquid other than the acidic aqueous solution may further contain an additive such as a surfactant if necessary, and the physical properties and the composition such as pH, solvent and additive are preferably so adjusted as not to cause a damage that renders the charging member not re-usable, for example by erosion of the surface of the charging member.

At the washing, there may be employed any method of supplying the surface of the charging member with the washing liquid, if it provides a state where at least the surface of the charging member is wetted with the washing liquid such as the acidic aqueous solution. More specifically, the washing liquid can be supplied to the surface of the charging member for example by immersing the charging member in the washing liquid filled in a washing tank, or by rocking the charging member in the washing liquid during such immersion, or washing the charging member by spouting the washing liquid for example from a nozzle, or exposing the charging member to the vapor of the washing liquid.

Also for improving the washing effect by the washing liquid itself, there may be employed any known auxiliary washing method without limitation, but it is preferable to use in combination a process of rub-washing of the surface of the charging member, and more preferable to use such rub-washing process in the step of washing with the acidic aqueous solution. The combined use of such rub-washing process allows to obtain effects of increasing the washing effect, reducing the washing time and simplifying the washing process.

At the rub-washing, there can be employed an auxiliary washing member for rub-washing which is maintained in contact with or pressed to the surface of the charging member. Such auxiliary washing member is not particularly limited, but can be composed for example of a foamed member of a synthetic resin, a brush or a felt material. The auxiliary washing member can be harder than the surface of the charging member, but, in such case, it is preferable to design the surfacial shape of the auxiliary washing member or the manner of contact or pressing of the auxiliary washing member to the surface of the charging member so as to achieve the rub-washing without damaging the surface of the charging member.

In case the charging member has a roll shape (hereinafter called "charging roll"), the rub-washing may be executed by contacting or pressing the auxiliary washing member to the surface of the charging member while the charging member is rotated. In such case, the rub-washing is preferably executed by moving the auxiliary washing member, in the axial direction of the charging roll, from a central portion toward an end portion thereof. In case the rub-washing is executed from the end portion toward the central portion, the charging member may show a peeling of the surface in the end portion in the axial direction and may become not re-usable.

In case of immersion washing, there can be employed a method of applying an ultrasonic wave as aforementioned auxiliary washing method. In such case, the rub-washing mentioned above may also be used in combination. In each washing step, the composition and concentration of the washing liquid to be used and the auxiliary washing method may be combined in arbitrary manner, and a washing step utilizing a same washing liquid or a washing step utilizing a same auxiliary washing method may be repeated plural times.

In case the washing method for the charging member includes at least two washing steps, it is preferable that at least the last washing step is a step of washing the surface of the charging member with a neutral aqueous solvent.

The washing with the neutral aqueous solvent in the last washing step allows to eliminate the component of a washing liquid such as an acidic aqueous solution, used in a washing step earlier than the last washing step and remaining on the surface of the charging member.

In the present invention, the neutral aqueous solvent means a washing liquid which is composed of water, water and a hydrophilic solvent, or a hydrophilic solvent only and has a pH value larger than 6 and not exceeding 8. The water to be employed in the neutral aqueous solvent can be purified water such as deionized water, but need not necessarily be subjected to strict control and management of the preparation process and the physical properties as in the case of such purified water. For example, there can be employed tap water or well water for home or industrial use. The content of impurities in such water is not particularly limited within an extent that no trace is formed resulting from the precipitation of the impurities after washing with the water and drying, but preferably 1 g/l or less and more preferably 0.1 g/l or less.

As aforementioned hydrophilic solvent there can be employed any known one for example an alcohol such as isopropyl alcohol, but preferred is a solvent that does not practically erode the surface of the charging member. Also the drying can be facilitated by selecting a solvent having a surface tension smaller than that of water.

It is also preferred that the surface of the charging member is maintained in a wetted state between the washing step and a next step. For example, in case of washing by moving the charging member through plural washing tanks, such state allows to prevent solidification of the components of the washing liquid, resulting from drying of the washing liquid sticking on the surface of the charging member in the course of movement thereof from a washing tank to another.

The drying method for the charging member after the last washing step is not particularly limited, but there can be employed known drying methods such as a spontaneous drying, a drying with warm air and an air blow drying for example by blowing compressed air, and such drying methods may be employed singly or in combination. Also, in case the charging member has a roll shape, the drying may be executed while such charging member is rotated.

The charging member may be re-used twice or more, by applying the above-described washing method for the charging member of the present invention in repetition. In such repeated re-use, the charging member can be used until the charging member becomes unusable in terms of the electrical characteristics for example because of a deterioration with time of the concentration of an electroconductive material in the charging member, or until the surface of the charging member is deteriorated or damaged by the repeated washing operations.

<Washing Apparatus>

The washing apparatus to be employed in the washing method for the charging member of the present invention is not particularly limited, and may have any configuration or structure capable of executing the washing method described in the foregoing. As an example, in case of washing a charging roll with the washing method described in the foregoing, there can be employed a washing apparatus explained in the following.

FIG. 1 is a schematic view showing an example of an immersion washing apparatus employable in the washing method for the charging member of the present invention. In FIG. 1, there are shown a charging roll 1, a washing liquid 2, a charging roll holder 3, a washing tank 4, a vertically movable lift 5, and an immersion washing apparatus 6. Referring to FIG. 1, both ends of the charging roll 1 are supported by the charging roll holder 3, which is fixed to the lift 5 so as to be movable in the vertical direction (indicated by an arrow A-A' in FIG. 1) of the washing tank 4. The washing tank 4 can hold the washing liquid 2 in such a manner that the charging roll 1 can be entirely immersed when the lift 5 is moved to the lower limit. The washing liquid 2 can be selected among various kinds according to the necessity, such as an acidic aqueous solution or a neutral aqueous solvent.

At the immersion washing, the charging roll 1 is fixed to the charging roll holder 3 in a state where the lift 5 is moved to the upper limit, then the charging roll 1 is immersed for a certain time in the washing liquid 2 filled in advance in the washing tank 4, and the charging roll 1 is thereafter lifted from the washing tank 4. During the immersion, the charging roll 1 may be vertically rocked within an extent that it does not emerge from the liquid surface of the washing liquid 2.

Figure 2:
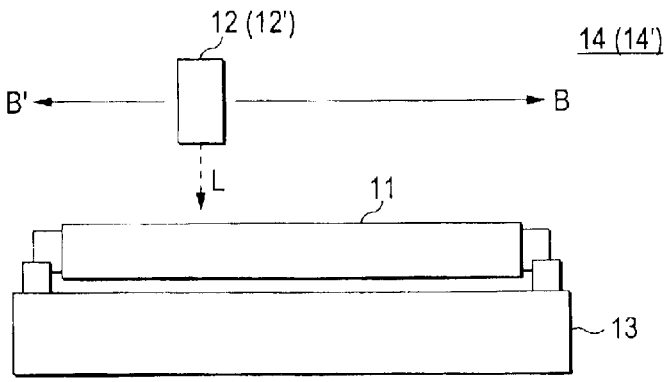
FIG. 2 is a schematic view showing an example of a washing apparatus (or a drying apparatus) of washing liquid dripping type, adapted for use in the washing method for the charging member of the present invention.

FIG. 2 is a schematic view showing an example of a washing apparatus of washing liquid dripping type, employable in the washing method for the charging member of the present invention. In FIG. 2, there are shown a charging roll 11, a washing liquid supply unit 12, a charging roll support member 13, and a washing apparatus 14 of washing liquid dripping type. Referring to FIG. 2, the charging roll 11 is supported at both ends thereof, in rotatable manner, by the charging roll support member 13. Also vertically above the charging roll 11, the washing liquid supply unit 12 is provided so as to be capable of parallel displacement along the axial direction (indicated by an arrow B-B' in FIG. 2) of the charging roll 11. The washing liquid supply unit 12 is connected to a washing liquid supply source of the acidic aqueous solution or the neutral aqueous solvent through a tube or a pipe (not shown), and, at the washing operation, supplies the washing liquid by dripping onto the surface of the charging roll as indicated by an arrow L in FIG. 2. The washing liquid can also be supplied by emitting or spouting under a pressure. In this operation, it is preferable to move the washing liquid supply unit 12 along the axial direction of the charging roll 11 while the charging roll 11 is rotated.

The apparatus shown in FIG. 2 may also be used as a drying apparatus 14' for the charging roll, by replacing the washing liquid supply unit 12 with a compressed air emitting nozzle 12'.

Figure 3:
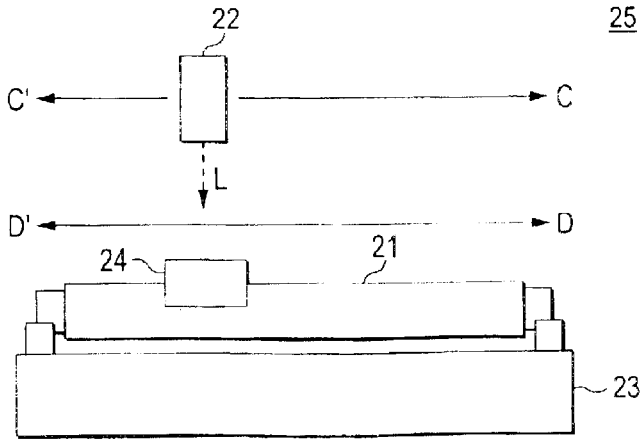
FIG. 3 is a schematic view showing another example of the washing apparatus of washing liquid dripping type, adapted for use in the washing method for the charging member of the present invention.

FIG. 3 is a schematic view showing another example of the washing apparatus of washing liquid dripping type, employable in the washing method for the charging member of the present invention, and shows a configuration of using the rub-washing in combination in the washing apparatus 14 of washing liquid dripping type shown in FIG. 2.

In FIG. 3, numerals 21, 22 and 23 respectively indicate members equivalent in shape and function to the charging roll 11, the washing liquid supply unit 12 and the charging roll support member 13 shown in FIG. 2, and the washing liquid supply unit 22 is capable, like the washing liquid supply unit 12 shown in FIG. 2, of parallel displacement along the axial direction (indicated by an arrow C-C' in FIG. 3) of the charging roll 21. An auxiliary washing member 24 composed for example of a plastic foamed member is so provided as to be capable of parallel displacement along the axial direction (indicated by an arrow D-D' in FIG. 3) of the charging roll 21, in a state in contact with or pressed to the surface of the charging roll 21. A numeral 25 indicates a washing apparatus of washing liquid dripping type, capable of rub-washing.

The washing apparatus 25 of washing liquid dripping type is capable, like the washing apparatus 14 of washing liquid dripping type shown in FIG. 2, of supplying the washing liquid from the washing liquid supply unit 22 onto the surface of the charging roll 21 as indicated by an arrow L while rotating the charging roll 21, and is also capable, during such operation, of contacting or pressing the auxiliary washing member 24 to the surface of the charging roll 21 thereby executing rub-washing of the surface of the charging roll 21. The washing may be executed by separately moving at least either of the washing liquid supply unit 22 and the auxiliary washing member 24 with respect to the axial direction of the charging roll 21 or by moving both in mutual linkage.

<Charging Member>

The charging member in the present invention is not particularly limited as long as it is capable of charging the member to be charged while being pressed to the surface thereof, and any known charging member can be used. For example, in case the charging member is a charging roll, there may be used a charging member prepared by forming a conductive elastic layer and a surface layer in succession on a hollow cylindrical conductive substrate or by forming a conductive elastic layer, a resistance layer and a surface layer in succession on a conductive substrate.

The conductive substrate functions as an electrode and a support member for the charging member, and is composed of an electroconductive material for example a metal or an alloy such as aluminum, a copper alloy or stainless steel; iron plated with chromium or nickel; or a conductive resin.

The conductive elastic layer is provided for forming a nip with the member to be charged, in order that the charging member is pressed with an appropriate nip pressure to the surface of the member to be charged thereby uniformly charging the surface of the member to be charged, and also for obtaining a predetermined resistance in the charging member.

The conductive elastic layer is formed for example by dispersing a conductive material in a rubber material. Examples of such rubber material include isoprene rubber, chloroprene rubber, epichlorohydrin rubber, butyl rubber, urethane rubber, silicone rubber, fluorinated rubber, styrene-butadiene rubber, butadiene rubber, nitrile rubber, ethylene-propylene rubber, epichlorohydrin-ethylene oxide copolymerized rubber, ethylene-propylene-diene copolymerized rubber, acrylonitrile-butadiene copolymerized rubber, natural rubber and blended rubber thereof. Among these, preferably employed is isoprene rubber, silicone rubber or ethylene-propylene rubber. Such rubber material can be foamed or non-foamed.

The conductive material can be an electronic conductive material or an ionic conductive material. Examples of the electronic conductive material include carbon black such as ketchen black or acetylene black; thermally decomposed carbon and graphite; conductive metals and alloys such as aluminum, copper, nickel or stainless steel; conductive metal oxides such as tin oxide, indium oxide, titanium oxide, tin oxide-antimony oxide solid solution, or tin oxide-indium oxide solid solution; and insulating materials of which surface is subjected to a conductive treatment, in a finely powdered state. Also examples of the ionic conductive material include perchlorate and chlorate salts of tetraethyl ammonium and lauryl trimethyl ammonium; and perchlorate and chlorate salts of alkali metals and alkali earth metals such as lithium or magnesium.

These conductive materials may be used singly or in a combination of two or more kinds. The addition amount thereof is not particularly limited, but, in case of aforementioned electronic conductive material, the addition amount is preferably within a range of 1 to 50 parts by mass, more preferably 5 to 35 parts by mass, with respect to 100 parts by mass of the rubber material. On the other hand, in case of aforementioned ionic conductive material, the addition amount is preferably within a range of 0.01 to 5 parts by mass, more preferably 0.1 to 4 parts by mass with respect to 100 parts by mass of the rubber material.

Thus the volumic resistivity of the conductive elastic layer is preferably adjusted within a range of $2\times10^2$ to $5\times10^9$ Ωcm. Also the hardness of the conductive elastic layer preferably does not exceed 80° in Asker C hardness.

The resistance layer is provided for adjusting the resistance of the charging roll, but may be dispensed with if so required. Also an electrode layer may be provided if necessary between the conductive elastic layer and the resistance layer.

The above-mentioned electrode layer is provided for dispersing the concentration of the current resulting from an uneven dispersion of the conductive particles in the conductive elastic layer, and is composed solely of a conductive inorganic substance.

The resistance layer is provided for adjusting the charging member at a predetermined resistance value, and is composed of a thin film formed by dispersing aforementioned conductive particles in a resin. The resin to be employed is not particularly limited, but a resin of more or less soft kind such as polyurethane, polyamide, polyester or acrylic resin is advantageous. Also as the conductive material, there can be advantageously employed the ones used in the conductive elastic layer.

The addition amount of aforementioned conductive material is not particularly limited, but, in case of an electronic conductive material, it is preferably within a range of 1 to 50 parts by mass, more preferably 5 to 35 parts by mass with respect to 100 parts by mass of the resin to be used.

Thus the volumic resistivity of the resistance layer is preferably adjusted within a range of $3\times10^3$ to $5\times10^{10}$ Ωcm. Also the thickness of the resistance layer is preferably within a range of 1 to 500 μm, more preferably 5 to 400 μm. A film thickness smaller than 1 μm not only prevents full exploitation of the function as the resistance adjusting layer but also tends to generate a leak, thereby leading to a damage on the surface of the member to be charged. On the other hand, a film thickness exceeding 500 μm may unnecessarily increase the resistance and the hardness of the charging member.

The surface layer functions as a layer for preventing the adhesion of the charging member to the surface of the member to be charged. It is provided also for preventing the smear of the charging member, resulting from the toner and the external additive material thereof, remaining on the surface of the member to be charged, also for preventing the deposition or adhesion of paper dust or similar substance to the surface of the member to be charged, thereby avoiding deterioration of the charging characteristics and generation of a defect in the image quality resulting therefrom.

The material constituting the surface layer is preferably composed of a polyamide resin as explained in the foregoing, but such material is not restrictive and there may be employed a resin or a rubber material which is relatively soft and causes little smear on the member to be charged.

EXAMPLES

In the following, the present invention will be clarified further by examples thereof, but the present invention is by no means limited to such examples.

In a washing test, there is employed a charging member for a developing cartridge which is to be used in an image forming apparatus DocuCenter 400 (trade name) manufactured by Fuji Xerox Co. Ltd. This charging member is a charging roll, having a diameter of 14 mm and having a surface layer composed of a methoxymethylated nylon resin of a thickness of 10 μm and a resistance layer composed of epichlorohydrin.

Prior to the washing test, an unused charging member of which electrical resistance is confirmed in advance is mounted on aforementioned image forming apparatus and is subjected to the formation of 36,000 images, and a washing is carried out thereafter in the following manner. The charging member after the washing is subjected to a measurement of the electrical resistance and a visual observation of the surface of the charging member, and again mounted on the above-mentioned image forming apparatus for an image formation test for confirming the image quality. The obtained results are summarized in Table 1.

Example 1

An unused charging roll is subjected to a formation 36,000 images to obtain a used charging roll. The surface of the charging member prior to the washing shows, under visual observation, adhesion of toner components and paper dusts.

There is employed an acidic aqueous solution obtained by dissolving following acid components in purified water as the solvent:

malic acid: 0.965 mass % glycollic acid: 0.675 mass % succinic acid: 0.016 mass %

The acidic aqueous solution employed in Example 1 has a pH value of 2.50 at 25° C. The pH measurement is executed with a pH meter (Castany-ACT D-215, manufactured by Horiba Seisakusho Co., Ltd.) based on a glass electrode method.

Then the washing tank of the immersion washing apparatus shown in FIG. 1 is filled with aforementioned acidic aqueous solution, and the above-mentioned used charging roll is subjected to immersion-washing therein for 1 minute. Then the washing apparatus of washing liquid dropping type, capable of rub-washing, shown in FIG. 3 is employed and rub-washing is executed under sufficient dripping of tap water, utilizing a foamed polyurethane resin member as the auxiliary washing member. The rub-washing is executed from the central portion of the charging roll toward the end portion thereof in the axial direction.

The charging roll after washing is blown with compressed air to blow off the water sticking on the surface, and is thereafter spontaneously dried over an entire day. The surface of the charging roll after the drying does not show adhesion of the toner components or the paper dusts under visual observation, nor scars resulting from the washing.

Table 1 shows that the electrical resistance of the charging roll after the washing is substantially same as that of the unused charging member, while the electrical resistance shows a significant increase in the charging roll after use (before washing). These results indicate that the electrical resistance increases by the toner components and the paper dusts adhered to the surface but is lowered by washing to the value same as in the unused charging roll.

Then the charging roll after the washing is subjected again to the formation of 36,000 images with confirmation of the presence or absence of defect in image quality at every 1,000 images, but no image defect is observed until 36,000 image formations and the washed charging roll is identified as re-usable.

On the other hand, another used charging roll subjected already to 36,000 image formations is subjected again to 36,000 image formations for the purpose of comparison, and such charging roll shows image defects in the course of such image formations.

Example 2

In Example 2, there is employed an acidic aqueous solution obtained by dissolving 2.000 mass % of malic acid as the acid component, in purified water as the solvent. The acidic aqueous solution has a pH of 2.46 at 25° C.

The washing and drying in Example 2 is conducted in the same manner as in Example 1, except for the use of aforementioned acidic aqueous solution.

The surface of the charging roll after the drying does not show adhesion of the toner components or the paper dusts under visual observation, nor scars resulting from the washing.

Also as shown in Table 1, the electrical resistance of the charging roll after the washing is substantially same as that of the unused charging member, while the electrical resistance shows a significant increase in the charging roll after use (before washing). These results indicate that the electrical resistance increases by the toner components and the paper dusts adhered to the surface but is lowered by washing to a level same as in the unused charging roll.

Then the charging roll after the washing is subjected again to the formation of 36,000 images with confirmation of the presence or absence of defect in image quality at every 1,000 images, but no image defect is observed until 36,000 image formations and the washed charging roll is identified as re-usable.

On the other hand, another used charging roll subjected already to 36,000 image formations is subjected again to 36,000 image formations for the purpose of comparison, and such charging roll shows image defects in the course of such image formations.

Example 3

In Example 3, there is employed an acidic aqueous solution obtained by dissolving 1.500 mass % of glycolic acid as the acid component, in purified water as the solvent. The acidic aqueous solution has a pH of 2.59 at 25° C.

The washing and drying in Example 3 is conducted in the same manner as in Example 1, except for the use of aforementioned acidic aqueous solution.

The surface of the charging roll after the drying does not show adhesion of the toner components or the paper dusts under visual observation, nor scars resulting from the washing.

Also as shown in Table 1, the electrical resistance of the charging roll after the washing is substantially same as that of the unused charging member, while the electrical resistance shows a significant increase in the charging roll after use (before washing). These results indicate that the electrical resistance increases by the toner components and the paper dusts adhered to the surface but is lowered by washing to a level same as in the unused charging roll.

Then the charging roll after the washing is subjected again to the formation of 36,000 images with confirmation of the presence or absence of defect in image quality at every 1,000 images, but no image defect is observed until 36,000 image formations and the washed charging roll is identified as re-usable.

On the other hand, another used charging roll subjected already to 36,000 image formations is subjected again to 36,000 image formations for the purpose of comparison, and such charging roll shows image defects in the course of such image formations.

Example 4

In Example 4, there is employed an acidic aqueous solution obtained by dissolving 0.04 mass % of succinic acid as the acid component, in purified water as the solvent. The acidic aqueous solution has a pH of 3.40 at 25° C.

The washing and drying in Example 4 is conducted in the same manner as in Example 1, except for the use of aforementioned acidic aqueous solution.

The surface of the charging roll after the drying does not show adhesion of the toner components or the paper dusts under visual observation, nor scars resulting from the washing.

Also as shown in Table 1, the electrical resistance of the charging roll after the washing is substantially same as that of the unused charging member, while the electrical resistance shows a significant increase in the charging roll after use (before washing). These results indicate that the electrical resistance increases by the toner components and the paper dusts adhered to the surface but is lowered by washing to a level same as in the unused charging roll.

Then the charging roll after the washing is subjected again to the formation of 36,000 images with confirmation of the presence or absence of defect in image quality at every 1,000 images, but no image defect is observed until 36,000 image formations and the washed charging roll is identified as re-usable.

On the other hand, another used charging roll subjected already to 36,000 image formations is subjected again to 36,000 image formations for the purpose of comparison, and such charging roll shows image defects in the course of such image formations.

Example 5

In Example 5, there is employed an acidic aqueous solution obtained by dissolving 1.500 mass % of malic acid and 0.350 mass % of glycolic acid as the acid components, in purified water as the solvent. The acidic aqueous solution has a pH of 2.53 at 25° C.

The washing and drying in Example 5 is conducted in the same manner as in Example 1, except for the use of aforementioned acidic aqueous solution.

The surface of the charging roll after the drying does not show adhesion of the toner components or the paper dusts under visual observation, nor scars resulting from the washing.

Also as shown in Table 1, the electrical resistance of the charging roll after the washing is substantially same as that of the unused charging member, while the electrical resistance shows a significant increase in the charging roll after use (before washing). These results indicate that the electrical resistance increases by the toner components and the paper dusts adhered to the surface but is lowered by washing to a level same as in the unused charging roll.

Then the charging roll after the washing is subjected again to the formation of 36,000 images with confirmation of the presence or absence of defect in image quality at every 1,000 images, but no image defect is observed until 36,000 image formations and the washed charging roll is identified as re-usable.

On the other hand, another used charging roll subjected already to 36,000 image formations is subjected again to 36,000 image formations for the purpose of comparison, and such charging roll shows image defects in the course of such image formations.

Comparative Example 1

In Comparative Example 1, the washing and drying is conducted in the same manner as in Example 1, except that the acidic aqueous solution employed in Example 1 is replaced by an organic solution obtained by dissolving 2 mass % of methylene chloride in purified water as the solvent. As a result, the surface of the charging roll after the washing shows generation of wrinkles, and is in a non-reusable state.

Comparative Example 2

In Comparative Example 2, the washing and drying is conducted in the same manner as in Example 1, except that the acidic aqueous solution employed in Example 1 is replaced by an aqueous solution obtained by dissolving an appropriate amount of a neutral detergent (Fine Clean 70; manufactured by Yokohama Oils and Fats Industries Co., Ltd.) in purified water as the solvent. As a result, the surface of the charging roll after the washing shows the deposited substances of a level similar to that prior to the washing, and a sufficient washing effect cannot be obtained.

Also the charging roll after the washing is subjected to the formation of 36,000 images with confirmation of the image quality at every 1,000 images as in Example 1, and shows image defects in the course of such image formations.

Evaluation of Electrical Resistance of Charging Roll

In Table 1, the measurement of the electrical resistance of three samples, namely the charging member before use, the charging member after 36,000 image formations (prior to washing) and the charging member after the washing is executed, in a measuring environment of 23° C. and 53% RH, by contacting an electrode roll of a width of 5 mm with the charging roll under a constant load and measuring the current value under the application of a DC voltage of 100 V directly to the metal core (conductive substrate) of the charging roll while it is rotated.

Evaluation Criteria for Image Quality with the Charging Roll After Washing

In Table 1, following evaluation criteria are employed for the image quality in the test of 36,000 image formations with the charging roll after the washing:

acceptable: no image defect observed under visual observation in any of the images at every 1,000 image formations from 0th to 36,000th image formations;

unacceptable: image defect observed under visual observation in at least any of the images at every 1,000 image formations from 0th to 36,000 image formations.

TABLE 1

| | Electrical resistance of charging roll (Ω) | | | | Image quality |
|---|---|---|---|---|---|
| | before use | after 36,000 image formations | after washing | Surface state of charging roll after washing | evaluation with charging roll after washing |
| Example 1 | $1.20 \times 10^5$ | $7.94 \times 10^5$ | $1.31 \times 10^5$ | no scar/smear | acceptable |
| Example 2 | $1.12 \times 10^5$ | $2.14 \times 10^6$ | $1.21 \times 10^5$ | no scar/smear | acceptable |
| Example 3 | $1.10 \times 10^5$ | $2.08 \times 10^6$ | $1.08 \times 10^5$ | no scar/smear | acceptable |

TABLE 1-continued

| | Electrical resistance of charging roll (Ω) | | | | Image quality |
|---|---|---|---|---|---|
| | before use | after 36,000 image formations | after washing | Surface state of charging roll after washing | evaluation with charging roll after washing |
| Example 4 | $1.05 \times 10^5$ | $8.65 \times 10^5$ | $1.09 \times 10^5$ | no scar/smear | acceptable |
| Example 5 | $1.00 \times 10^5$ | $9.89 \times 10^5$ | $1.02 \times 10^5$ | no scar/smear | acceptable |
| Comp.Ex. 1 | — | — | — | wrinkles generated | not evaluable |
| Comp.Ex. 2 | — | — | — | smear remaining | unacceptable |

As explained in the foregoing, the present invention is capable of removing the deposited substance on the surface of the charging member without deteriorating the surface thereof by washing the surface of the charging member with the acidic aqueous solution at least once, thereby providing a washing method for the charging member for enabling re-use thereof.

What is claimed is:

1. A washing method for a charging member of an electrophotographic system, comprising:

a step of washing the surface of the charging member at least once with an acidic aqueous solution having at least a carboxylic acid, the carboxylic acid including a hydroxyl group.

2. A washing method for a charging member according to claim 1, wherein the surface of the charging member is coated with a polyamide resin.

3. A washing method for a charging member according to claim 1, wherein the acidic aqueous solution has a pH value within a range from 2 to 5.

4. A washing method for a charging member according to claim 1, wherein the carboxylic acid includes one or two hydroxyl groups and one or two carboxyl groups.

5. A washing method for a charging member according to claim 1, further comprising a process of rub-washing of the surface of the charging member.

6. A washing method for a charging member according to claim 1, wherein at least two washing steps are included, and at least a last washing step executes washing with a neutral aqueous solvent.

7. A method of washing a charging member of an electrophotographic system comprising:

mixing water and an acidic component to provide an acidic aqueous solution having a carboxylic acid which includes a hydroxyl group, the acidic aqueous solution having a pH value not exceeding 6 at 25 degrees centigrade; and washing the surface of a charging member with the acidic aqueous solution.

8. The method of claim 7 comprising:

washing the surface of the charging member with an aqueous solvent having a pH value greater than 6 at 25 degrees centigrade.

* * * * *